US007340989B2

(12) United States Patent
Schönauer

(10) Patent No.: US 7,340,989 B2
(45) Date of Patent: Mar. 11, 2008

(54) INDUSTRIAL TRUCK HAVING A PISTON/CYLINDER ARRANGEMENT AND IMPROVED CYLINDER MOUNTING

(75) Inventor: Michael Schönauer, Moosburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 0 days.

(21) Appl. No.: 11/119,620

(22) Filed: May 2, 2005

(65) Prior Publication Data

US 2006/0027094 A1 Feb. 9, 2006

(30) Foreign Application Priority Data

May 6, 2004 (DE) ..... 10 2004 022 338

(51) Int. Cl.
*F01B 29/00* (2006.01)

(52) U.S. Cl. ..... 92/161

(58) Field of Classification Search ..... 92/161
See application file for complete search history.

(56) References Cited

U.S. PATENT DOCUMENTS

| | | | | |
|---|---|---|---|---|
| 3,394,778 A | | 7/1968 | Brinton | |
| 4,294,572 A | * | 10/1981 | Pattison | 414/641 |
| 4,430,924 A | * | 2/1984 | Dunn et al. | 92/161 |
| 4,768,606 A | * | 9/1988 | Abels et al. | 92/161 |
| 5,934,171 A | * | 8/1999 | Thompson | 92/161 |

FOREIGN PATENT DOCUMENTS

| | | |
|---|---|---|
| DE | 66 05 077 | 11/1969 |
| DE | 29 05 084 | 2/1979 |
| DE | 44 00 979 A1 | 1/1994 |
| DE | 195 19 526 A1 | 5/1995 |
| EP | 0 663 507 B1 | 7/1995 |

OTHER PUBLICATIONS

German Search Report published Feb. 16, 2003.
Roth, K., descriptive patent material published in Berlin Jul. 13, 1994.
Schulte, R., descriptive patent material published in Munich Jul. 5, 2001.

* cited by examiner

*Primary Examiner*—F. Daniel Lopez
(74) *Attorney, Agent, or Firm*—Edwards Angell Palmer & Dodge LLP

(57) ABSTRACT

In the case of an industrial truck having a piston/cylinder arrangement (20), comprising a cylinder (26) and a piston (22), which can be extended out of and withdrawn into said cylinder (26), as a drive and/or as guidance for a first component (12) for the purpose of moving it in relation to a second component (14), in particular as a drive for components (12, 14) of a lifting system (10), the piston (22) is coupled for force transfer purposes to a component (14) associated with it (first or second component), and the cylinder (26) is mounted on a cylinder bearing (34) of the respective other component (12) associated with the cylinder (26) and is coupled to said component (12) for force transfer purposes. According to the invention, the cylinder (26) is in bearing engagement with the cylinder bearing (34) such that it can be moved in relation to the cylinder bearing (34).

13 Claims, 1 Drawing Sheet

Figure 1A:
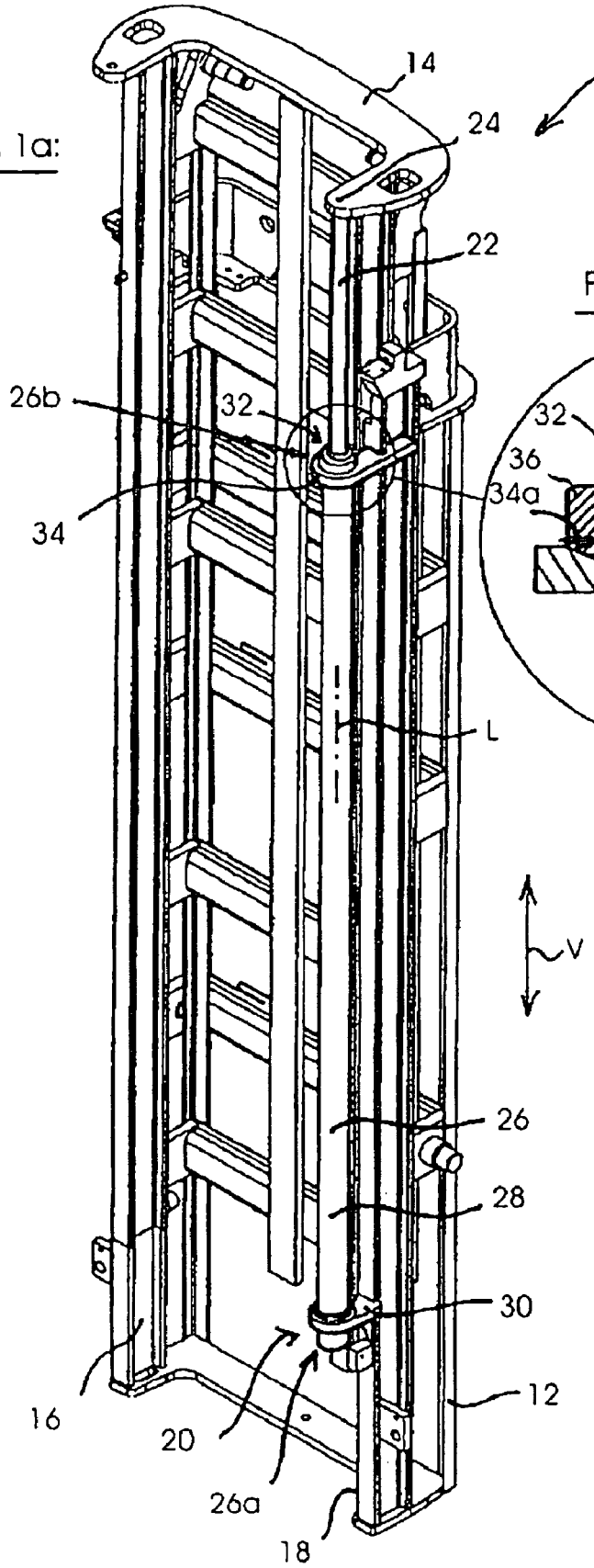

INDUSTRIAL TRUCK HAVING A PISTON/CYLINDER ARRANGEMENT AND IMPROVED CYLINDER MOUNTING

The present invention relates to an industrial truck having a piston/cylinder arrangement, comprising a cylinder and a piston, which can be extended out of and withdrawn into said cylinder, as a drive and/or as guidance for a first component for the purpose of moving it in relation to a second component, in particular as a drive for components of a mast, the piston being coupled for force transfer purposes to a component associated with it (first or second component), and the cylinder being mounted on a cylinder bearing of the respective other component associated with the cylinder and being coupled to said component for force transfer purposes.

Such industrial trucks are generally known in the prior art. For example, fork-lift trucks having telescopic masts are known in the case of which an upright is mounted on a frame of the industrial truck such that it is fixed to the frame, and a lifting frame is mounted and guided on the upright such that it can be displaced in relation to it.

Furthermore, industrial trucks are known in the case of which, as an alternative or in addition to the above-described masts, further relatively movable components are provided, such as additional lifting elements, load carriers, in particular fork carriers, side-loaders etc. In the case of all of these apparatuses, a first and a second component are arranged on an industrial truck such that they can move in relation to one another.

Primarily, but not exclusively, piston/cylinder arrangements are used as drives and/or as guidance for an extending and withdrawing movement of lifting frames in relation to uprights which are fixed to the industrial truck frame. In order to obtain a structure for a mast on the industrial truck which is as stable as possible and which can carry as great a load as possible, the cylinder is generally connected to the component bearing it as rigidly as possible at at least one bearing point.

Owing to tolerances which are usual during production and assembly and owing to deformation under load, there may be shape and mounting errors, such as alignment errors, on the piston and the cylinder or between said piston and cylinder. "Alignment errors" in this context means that the piston longitudinal axis and cylinder longitudinal axis are not ideally coaxial, but are slightly offset with respect to one another in an offset direction which is orthogonal with respect to the cylinder longitudinal axis direction and/or are tipped slightly about an axis of rotation which is orthogonal with respect to the cylinder longitudinal axis direction. Such alignment errors take effect in particular in the case of a piston which is extended far out of the cylinder, since the piston can be guided more accurately through the cylinder the longer the stretch of piston which is still in the cylinder. In the case of a piston which is extended far out of the cylinder, the guide length of the stretch of piston remaining in the cylinder is small, which, in the case of a load which is to be held far away from a piston opening of the cylinder, leads to supporting moments which are too high on the cylinder in the vicinity of the piston opening. These supporting moments need to be absorbed as forces by the cylinder bearing and be supported by the component on which the cylinder bearing is provided.

It is therefore the object of the present invention to specify an industrial truck of the type mentioned initially, in the case of which an industrial truck component, bearing the cylinder of a piston/cylinder arrangement, is subjected to a lesser load.

This object is achieved in the case of a generic industrial truck by the cylinder being in bearing engagement with the cylinder bearing such that it can be moved in relation to the cylinder bearing.

If the cylinder is in bearing engagement with the cylinder bearing such that it can move in relation to said cylinder bearing, the cylinder may carry out a compensatory movement in a direction in which deviations in shape and/or position from the ideal shape or the ideal position, such as alignment errors between the piston and the cylinder, are reduced, as a result of which a supporting moment which is exerted on the cylinder in the region of the piston opening of the cylinder is also reduced. That is to say, this supporting moment is proportional in value to the value of alignment errors. The relative value of the inaccuracies in shape and/or position is reduced by a compensatory movement, as is made possible by the cylinder mounting in accordance with the invention.

Furthermore, the cylinder, driven by the supporting moment acting on it by the extended piston, is moved in a direction in which this supporting moment exerted on it becomes smaller, with the result that the industrial truck, with the cylinder mounted such that it can move, represents, within certain limits, a self-optimizing system. Dedicated control for moving the cylinder in a suitable direction is not required.

Although cylinders which are mounted such that they can move or in an articulated manner, in particular hydraulic cylinders, are known in numerous applications in the prior art, in the precise case of industrial trucks, those skilled in the art have to date assumed that guidance, which is as exact as possible, of components which move in relation to one another, in particular components of a lifting system, should be driven and/or guided on an industrial truck by a piston/cylinder arrangement which is mounted as rigidly as possible. Credit should be given to the inventor of the present invention for circumventing this prejudice of the relevant specialist world.

The piston/cylinder arrangement is preferably a hydraulic drive, which is suitable for lifting and/or lowering large loads. In the case of such piston/cylinder arrangements, the cylinder has a closed longitudinal end and a longitudinal end having a piston opening, the cylinder bearing, for the purpose of advantageously preventing excessive cylinder deformation, bearing the cylinder in the region of its longitudinal end having the piston opening. Since a seal, which seals off the piston opening against the ingress of dirt into the cylinder chamber and possibly against the emergence of hydraulic fluid, is provided at the piston opening, there is touching contact here between the piston and the cylinder, by means of which forces are introduced from the piston into the cylinder. These forces may lead to deformation of the cylinder to a lesser extent the nearer the cylinder bearing is to the piston opening. The cylinder bearing is preferably provided such that the piston opening is arranged no further than 20% of the total length of the cylinder away from the cylinder bearing. More advantageously, the distance of the piston opening from the cylinder bearing should not exceed 10% of the total length of the cylinder. Particularly high forces may be absorbed without notable deformation of the cylinder if the piston opening is arranged no further than 5% of the total length of the cylinder away from the cylinder bearing.

It should be added that a movement of the cylinder and the cylinder bearing in relation to one another only represents a slight local relative movement in the region of the cylinder bearing. The ability of the cylinder and the cylinder bearing to move in relation to one another at the point at which the cylinder is mounted should, for example, not exclude the possibility of the cylinder being mounted at a further bearing point on the component associated with it or on another component. This further bearing point of the cylinder may be a movable bearing point or even a rigid bearing point, with the result that the ability of the cylinder to move locally in the region of the cylinder bearing discussed here and in relation to said cylinder bearing is essentially set in the last-mentioned case by a deformation of the cylinder.

In order for it to be possible for the cylinder to reduce an offset of the cylinder longitudinal axis and the piston longitudinal axis, which is essentially parallel to said cylinder longitudinal axis, by a movement in relation to the cylinder bearing, the cylinder may be provided such that it can be displaced in relation to the cylinder bearing in at least one displacement direction, which is orthogonal with respect to the cylinder longitudinal axis direction, preferably in two displacement directions, which are orthogonal both with respect to one another and with respect to the cylinder longitudinal axis direction.

As an alternative or in addition, the cylinder may be mounted on the cylinder bearing so as to reduce tipping of the cylinder and piston longitudinal axes in relation to one another such that it can be tipped in relation to the cylinder bearing about at least one tipping axis, which is orthogonal with respect to the cylinder longitudinal axis direction, preferably about two tipping axes, which are orthogonal both with respect to one another and with respect to the cylinder longitudinal axis direction.

The latter variant is preferred to the first-mentioned possibility for an ability of the cylinder to be displaced in relation to the cylinder bearing since, on the one hand, given slight movements which are of concern here, compensatory tipping brings about a notable reduction even in the forces acting on the cylinder bearing owing to a longitudinal axis offset, discussed above, on the cylinder, and, on the other hand, a bearing which has an ability to tip the cylinder in relation to the cylinder bearing can be designed to be more rigid than a cylinder bearing having a cylinder which can be displaced in relation to said cylinder bearing.

Furthermore, it can easily be seen that an ability to be displaced, whether it be an ability to be displaced or to tip in two displacement directions, which are orthogonal with respect to one another, or about two tipping axes, which are orthogonal with respect to one another, represents a significantly greater possibility for correcting errors than an ability to be displaced with only one displacement direction, which is orthogonal with respect to the cylinder longitudinal axis direction, or one tipping axis, which is orthogonal with respect to the cylinder longitudinal axis direction. However, if, for example owing to the action of a force which is always the same, a definitely required compensatory movement direction is known, an ability to be displaced in only one displacement direction or about only one tipping axis may be advantageous, since this bearing can be designed to be more rigid than a bearing having a possibility of two-axis displacement.

Using means which are simple in design terms and are thus cost-effective, it is possible to achieve a situation in which the cylinder and the cylinder bearing can be moved in relation to one another by the cylinder having a bearing formation having a supporting surface which is in bearing engagement with a cylinder bearing surface of the cylinder bearing.

In this case, it is also possible using simple means to obtain a situation in which the cylinder can be tipped in relation to the cylinder bearing if at least one of the surfaces (supporting surface and cylinder bearing surface) is curved convexly, at least in the region of the bearing engagement, about at least one axis of curvature, which is orthogonal with respect to the cylinder longitudinal axis direction. The supporting surface and/or the cylinder bearing surface may in this case be in the form of a cylinder casing part surface, for example.

In this case, it is in principle possible for both surfaces to be curved convexly or for one of the surfaces to be planar. Furthermore, a situation in which the cylinder can be tipped or rotated about at least two tipping axes, which are orthogonal with respect to one another and with respect to the cylinder longitudinal axis direction, can be achieved by the supporting surface and the cylinder surface each being curved convexly only about an axis of curvature, which is orthogonal with respect to the cylinder longitudinal axis direction, but by the axis of curvature of the supporting surface and the axis of curvature of the cylinder bearing surface lying orthogonal with respect to one another. Such solutions, however, lead to very high surface pressures at the point of contact between the supporting surface and the cylinder bearing surface, which is less preferred.

As has already been mentioned above, a particularly good possibility for compensating for manufacturing and/or assembly errors can be obtained if at least one of the surfaces (supporting surface and cylinder bearing surface) is curved convexly, at least in the region of the bearing engagement, about two axes of curvature, which are orthogonal both with respect to one another and with respect to the cylinder longitudinal axis direction. In this case, the cylinder can be tipped or rotated in relation to the cylinder bearing about any desired tipping axis which is orthogonal with respect to the cylinder longitudinal axis direction.

For example, at least sections of the supporting surface and/or the cylinder bearing surface may be in the form of a barrel, with the result that different radii of curvature are associated with different tipping axes, which may lead to a preferred tipping axis. This may be desirable if a preferred compensatory movement is known, since although in this case a compensatory tipping movement about a tipping axis which is orthogonal with respect to the preferred tipping axis is still possible, a tipping ability which has been made more difficult always allows an increase in the rigidity of the bearing.

In many cases, no preferred compensatory movements can be determined, since manufacturing and/or assembly errors are often unsystematic and occur at random. A universal possibility for a compensatory tipping movement, which can be carried out under the same conditions about any desired tipping axis which is orthogonal with respect to the cylinder longitudinal axis direction, is advantageously obtained if the at least one convexly curved surface is in the form of a spherical dome.

If the intention is for the cylinder still to be clamped at a further bearing point, it is advantageous if the radius of the spherical dome corresponds to the spacing of the curved surface from the further clamping, since in this case the relative movement of the cylinder and the cylinder bearing can take place with only very little deformation of the cylinder.

Improved guidance of the relative tipping movement of the cylinder and cylinder bearing can be obtained by one of the surfaces (supporting surface and cylinder bearing surface) being curved convexly, at least in the region of the bearing engagement, about at least one axis of curvature, which is orthogonal with respect to the cylinder longitudinal axis direction, and the respective other surface (cylinder bearing surface and supporting surface) being curved concavely, at least in the region of the bearing engagement, about at least one axis of curvature, which is orthogonal with respect to the cylinder longitudinal axis direction.

With the abovementioned development of the present invention, the cylinder can be mounted in a very robust manner and such that it has a long life if the supporting surface and the cylinder bearing surface are curved such that they bear flat against one another. That is to say, with this refinement the surface pressure acting between the supporting surface and the cylinder bearing surface is very low. The larger the contact area between the supporting surface and the cylinder bearing surface, the lower the surface pressure.

In principle, the supporting surface may be provided in any desired manner on the cylinder. In one development of the present invention, which requires a very small amount of physical space, the supporting surface extends along a circumferential section of the cylinder. A higher load-bearing capacity of the supporting surface with ever more efficient use of the existing physical space results if the supporting surface surrounds the cylinder in the circumferential direction. In addition, this makes it possible for a force which is to be supported on the cylinder bearing to be introduced uniformly into the supporting surface.

In order to simplify assembly of the piston/cylinder arrangement, the cylinder may comprise a cylinder tube and a cylinder closure having a piston opening. In this case, the piston may be introduced into the cylinder in a very simple manner. Since the cylinder closure can be worked with more easily and thus more cost-effectively owing to its essentially smaller size compared to the cylinder tube, the supporting surface may advantageously be provided as the at least one surface, which is curved at least in sections, on the cylinder closure. This is particularly the case if the cylinder closure is a separate component at least at the time prior to its connection to the cylinder tube.

Since the piston/cylinder arrangement is generally a hydraulic adjusting device in the case of which, depending on the desired protruding length of the piston from the cylinder, hydraulic fluid is introduced into the cylinder or guided away out of the cylinder, from the viewpoint of a simple installation of the hydraulic lines it is advantageous if the first component is connected indirectly or directly and fixedly to an industrial truck frame, and the second component is mounted such that it can move in relation to the first component, the first component, which is fixed to the frame, being associated with the cylinder, and the second component, which is mounted such that it can move, being associated with the piston. That is to say, if the cylinder is connected to the component which is fixed to the frame, the spacing of the connection point for the hydraulic fluid on the cylinder in relation to the industrial truck frame does not change, which, on the one hand, makes it possible to use hydraulic lines which are as short as possible and, on the other hand, does not flex the hydraulic lines owing to the movement. Even stable tubes may be used as the hydraulic lines.

As has already been mentioned by way of example initially, the first component may be an upright, and the second component a lifting frame. As an alternative or in addition, the first component may also be a rack of an additional lifting device, and the second component a load carrier, in particular a fork carrier, which is mounted on said rack such that it can move.

Figure 1B:
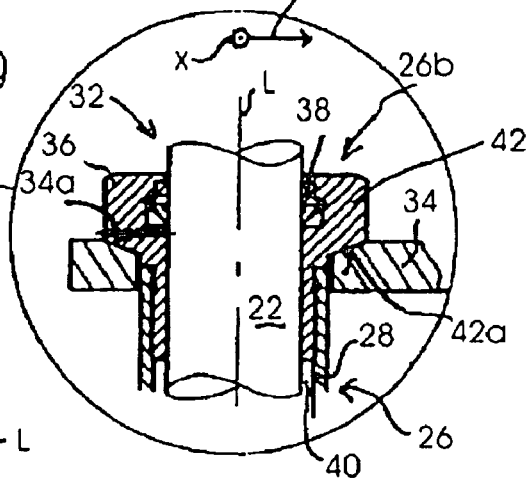

The present invention will be explained in more detail below with reference to the attached drawings, in which:

FIG. 1*a* shows, by way of example, an upright and a lifting frame, which moves in relation to said upright, of an industrial truck, such as a stacker, FIG. 1*b* shows the mounting of the cylinder shown in FIG. 1*a* in detail and in longitudinal section.

FIG. 1*a* illustrates a mast 10, comprising an upright 12, which is fixed to a frame of an industrial truck (not shown), and a lifting frame 14, which moves in relation to the upright 12. The lifting frame 14 is guided in guide rails 16 and 18 of the upright 12 for the purpose of moving it in relation to the upright 12 in the direction of the double arrow V.

Acting as the movement drive are two hydraulic piston/cylinder arrangements, which have essentially the same design and are mounted in essentially the same manner and of which, for reasons of clarity, only the right-hand piston/cylinder arrangement 20 is illustrated. The description given below of the right-hand piston/cylinder arrangement 20 also relates to the left-hand piston/cylinder arrangement not illustrated.

A piston 22 of the piston/cylinder arrangement 20 is fixedly connected at its free longitudinal end to a coupling point 24 of the lifting frame 14. The piston 22 can exert both tensile and compression forces on the lifting frame 14 at the coupling point 24.

Furthermore, the piston/cylinder arrangement 20 comprises a cylinder 26 having a cylinder tube 28. The cylinder longitudinal axis L is parallel to the movement direction V of the relative movement between the lifting frame 14 and the upright 12. In the exemplary embodiment illustrated, the cylinder 26 is retained on the upright 12 at its lower longitudinal end 26*a* in FIG. 1*a*. It is retained by means of a movable bearing 30 known per se. In this case, movement damping can be provided in order to damp a relative movement between the longitudinal end 26*a* and the movable bearing 30. At its opposite longitudinal end 26*b*, which has a piston opening 32, the cylinder 26 is mounted such that it can move slightly in relation to a cylinder bearing 34 surrounding it. The cylinder bearing 34 in the example shown comprises a metal plate having a hole, through which the cylinder 26 passes.

FIG. 1*b* shows a detail of the mounting at the longitudinal end 26*b* at which the piston opening 32 is provided.

A cylinder closure 36 is inserted in the cylinder tube 28 and fixedly connected to it, for example by being screwed in or by being plugged in and subsequently welded.

A sealing arrangement 38, which surrounds the piston 22 along its circumference and prevents the ingress of dirt into the interior 40 of the cylinder 26 or the emergence of hydraulic fluid from it, is provided in the cylinder closure 36.

The cylinder closure 36 has a bearing formation 42, which protrudes radially outwards with respect to the cylinder tube 28, to be precise along the entire circumference of the cylinder closure 36. The bearing formation 42, which surrounds the piston 22 and the cylinder 26, has a supporting surface 42*a*, which is in the form of a spherical dome and points towards the cylinder bearing 34. This supporting surface 42*a* rests on a partially spherical, concave cylinder bearing surface 34*a* of the cylinder bearing 34. In this case, the radii of curvature of the spherical dome surface 42*a* and the partially spherical cutout 34*a* are selected to be essentially the same, with the result that the supporting surface

42*a* bears flat against the cylinder bearing surface 34*a*. The cylinder 26 can thus tip in the region of the point of contact between the supporting surface 42*a* and the cylinder bearing surface 34*a* both about a first axis X, which is orthogonal with respect to the cylinder longitudinal axis L, and about a second axis Y, which is orthogonal with respect to the cylinder longitudinal axis L and with respect to the first axis X.

The pivoting or tipping axes X and Y are illustrated in FIG. 1*b* for reasons of space at the upper end in FIG. 1*b*. However, it will be understood that the true tipping axes X and Y given the same relative movement between the supporting surface 42*a* and the cylinder bearing surface 34*a* pass through the centre of curvature of the supporting surface 42*a*, which lies on the partially spherical, concave cylinder bearing surface 34*a*, of the bearing formation 42 of the cylinder closure 36.

If the cylinder is mounted, as described, close to the spherical opening 32, a slight rotation of the longitudinal end 26*b* in relation to the cylinder bearing 34 is possible, as a result of which manufacturing and/or assembly inaccuracies of the piston/cylinder arrangement 10 can be compensated for at least partly and can thus be reduced. As a result, a torque, which is exerted by the piston 22 on the cylinder 26 owing to such inaccuracies and which above all threatens to become large in the case of a piston 22 which has been extended far out of the cylinder 26, can thus be reduced, which leads to the cylinder 26 and the piston 22 as well as the cylinder bearing 34 and thus the upright 12 being subjected to a lesser load.

Firstly, the components referred to may thus be given correspondingly weaker dimensions or may have, given identical dimensions, a correspondingly longer life.

Alternatively, the cylinder bearing 34 may also be formed with a convexly curved cylinder bearing surface, and the cylinder 26 with a supporting surface which is curved correspondingly concavely, but a concave cutout can be formed more easily in the essentially planar cylinder bearing 34 than a cylinder bearing surface which is curved correspondingly convexly. A convexly curved supporting surface can be produced in a simple manner on the cylinder 26 or particularly advantageously on the cylinder closure 36 by means of lathe work.

The invention claimed is:

1. An industrial truck having a mast and a piston/cylinder arrangement, comprising a cylinder and a piston, which can be extended out of and withdrawn into said cylinder, as a drive and/or as guidance for a first component of said mast for the purpose of moving the first component in relation to a second component of said mast, the piston being coupled for force transfer purposes to a mast component associated therewith, and the cylinder being mounted on a cylinder bearing of the respective other mast component associated with the cylinder and being coupled to said mast component for force transfer purposes, wherein the cylinder is in bearing engagement with the cylinder bearing such that it can be moved in relation to the cylinder bearing, wherein the cylinder has a cylinder tube and a cylinder closure having a piston opening and wherein the cylinder has a bearing formation having a supporting surface provided on the cylinder closure and surrounding the cylinder in the circumferential direction, said supporting surface being in bearing engagement with a cylinder bearing surface of the cylinder bearing, wherein at least one of the supporting surface and the cylinder bearing surface is curved convexly, at least in the region of the bearing engagement, about two axes of curvature, which are orthogonal both with respect to one another and with respect to the cylinder longitudinal axis direction, and the respective other cylinder bearing surface and supporting surface is curved concavely, at least in the region of the bearing engagement, about two axes of curvature, which are orthogonal both with respect to one another and with respect to the cylinder longitudinal axis direction, and wherein the supporting surface and the bearing surface are curved such that they bear flat against one another, and wherein the cylinder can be displaced in relation to the cylinder bearing in at least one displacement direction, which is orthogonal with respect to the cylinder longitudinal axis direction.

2. An Industrial truck according to claim 1, wherein the cylinder has a closed longitudinal end and a longitudinal end having a piston opening, and the cylinder bearing bears the cylinder in the region of its longitudinal end having the piston opening, which starts from the longitudinal end having the piston opening, of 20% of the total length of the cylinder.

3. An industrial truck according to claim 2, wherein the cylinder closure is a separate component at least prior to its connection to the cylinder tube.

4. An industrial truck according to claim 2, wherein the cylinder has a closed longitudinal end and a longitudinal end having a piston opening, and the cylinder bearing bears the cylinder in the region of its longitudinal end having the piston opening, which starts from the longitudinal end having the piston opening, of 10% of the total length of the cylinder.

5. An industrial truck according to claim 4, wherein the cylinder has a closed longitudinal end and a longitudinal end having a piston opening, and the cylinder bearing bears the cylinder in the region of its longitudinal end having the piston opening, which starts from the longitudinal end having the piston opening, of 5% of the total length of the cylinder.

6. An industrial truck according to claim 1, wherein the cylinder can be displaced in relation to the cylinder bearing in two displacement directions, which are orthogonal both with respect to one another and with respect to the cylinder longitudinal axis direction.

7. An industrial truck according to claim 1, wherein the cylinder can be tipped in relation to the cylinder bearing about at least one tipping axis which is orthogonal with respect to the cylinder longitudinal axis direction.

8. An industrial truck according to claim 7, wherein the cylinder can be tipped in relation to the cylinder bearing about two tipping axes, which are orthogonal both with respect to one another and with respect to the cylinder longitudinal axis direction.

9. An industrial truck according to claim 1, wherein the at least one surface, which is curved convexly at least in sections, is in the form of a spherical dome.

10. An industrial truck according to claim 1, wherein the first component is fixedly connected to an industrial truck frame, and the second component is mounted such that it can move in relation to the first component, the first component, which is fixed to the frame, being associated with the cylinder, and the second component, which is mounted such that it can move, being associated with the piston.

11. An industrial truck according to claim 10, wherein the first component is an upright, and the second component is a lifting frame.

12. An industrial truck according to claim 1, wherein the first component is a rack of an additional lifting device, and the second component is a load carrier, which is mounted for movement on said rack.

13. An industrial truck according to claim 12, wherein the load carrier is a fork carrier.

* * * * *